US005527166A

United States Patent [19]

Chang et al.

[11] Patent Number: 5,527,166

[45] Date of Patent: Jun. 18, 1996

[54] MECHANISM FOR LOCATING A FIXED VOLUTE OF SCROLL COMPRESSOR

[75] Inventors: Yu-Choung Chang, Taipei; Kun-Yi Liang, Hsinchu; Tse-Liang Hsiao, Hsinchu; Chih-Cheng Yang, Hsinchu, all of Taiwan

[73] Assignee: Industrial Technology Research Institute, Hsinchu, Taiwan

[21] Appl. No.: 514,855

[22] Filed: Aug. 14, 1995

[51] Int. Cl.[6] ..... F01C 1/04

[52] U.S. Cl. ..... 418/55.2; 418/55.5; 418/57

[58] Field of Search ..... 418/55.2, 55.4, 418/55.5, 57

[56] References Cited

U.S. PATENT DOCUMENTS

| | | | |
|---|---|---|---|
| 4,767,293 | 8/1988 | Caillat et al. . | |
| 4,877,382 | 10/1989 | Caillat et al. . | |
| 5,101,316 | 4/1992 | Caillat et al. . | |
| 5,342,185 | 8/1994 | Anderson | 418/57 |
| 5,435,707 | 7/1995 | Hirano et al. | 418/55.2 |
| 5,458,471 | 10/1995 | Ni | 418/55.2 |

*Primary Examiner*—Charles Freay

*Attorney, Agent, or Firm*—Browdy and Neimark

[57] ABSTRACT

A locating mechanism of the fixed volute of a scroll compressor comprises a frame, a fixed volute and an orbiting volute. The frame is provided with a predetermined number of locating faces having thereon respectively a locating member which is fastened with the frame and has a sliding connection face of an arcuate construction. The fixed volute is provided with a predetermined number of shoulders which are corresponding in location and number to the locating members and are provided respectively on the outer side thereof with a sliding connection face of an arcuate construction and engageable with the sliding connection face of the locating member. The fixed volute can be caused to slide up and down along the sliding connection face of the locating member. The sliding connection face of the locating member is provided on the top thereof with a retaining portion for preventing the fixed volute from moving upward. The shoulders of the fixed volute can be fastened with the retaining portions of the locating members by a temporary member, thereby causing the fixed volute to be suspended on the locating members so as to allow the fixed volute and the orbiting volute to form therebetween a gap enabling the fixed volute to adjust itself to locate at the optimum cooperating position.

9 Claims, 6 Drawing Sheets

MECHANISM FOR LOCATING A FIXED VOLUTE OF SCROLL COMPRESSOR

FIELD OF THE INVENTION

The present invention relates generally to scroll compressor, and more particularly to a locating mechanism of a fixed volute of the scroll compressor.

BACKGROUND OF THE INVENTION

The scroll-type compressor is basically composed of a plurality of compression chambers formed by a fixed volute and an orbiting volute engageable with the fixed volute. The poorly-assembled compression chambers are prone to have gaps responsible for causing the compressed work fluid to leak out badly from the side wall of the scroll piece or the root of volute, thereby undermining seriously the volume efficiency of the compressor. In order to overcome such a deficiency as described above, it is necessary that the elements making up the compressor must be made with precision, and that the locating mechanisms of the fixed and the orbiting scroll members must be improved.

In addition, the scroll compressor is vulnerable to damage by the work fluid containing accidentally a foreign object which is either solid or liquid and can not be compressed. Such a noncompressible object can cause the work fluid to have an excessive pressure in the compression chambers of the scroll compressor, thereby making the compressor vulnerable to damage unless the excessively compressed work fluid is discharged in a timely manner via a gap formed elastically by two scroll members. The solution to the problem described above can be further enhanced by an improvement in the locating mechanisms of two scroll members. The prior art improvements in the locating mechanisms of two scroll members of the scroll compressor are described hereinafter.

As exemplified by the disclosures in the U.S. Pat. Nos. 4,767,293 and 4,877,382, the non-orbiting scroll member is provided in the back thereof with a biasing piece device which is fastened securely with a frame by means of bolts in conjunction with a locating piece. In the meantime, the biasing piece device is locked with the non-orbiting scroll member by another set of bolts. The non-orbiting scroll member is capable of moving axially. The moving distance of the non-orbiting scroll member is regulated by the interval between the planar surface of the frame holding the non-orbiting scroll member and the planar surface of the frame locking the biasing piece device, as well as the rim thickness of the non-orbiting scroll member. When the work fluid in the compression chamber has an abnormal pressure, the axial separation force of the compression chamber is greater than the axial sealing force exerting on the back of the non-orbiting scroll member. As a result, a gap is formed between the orbiting scroll member and the non-orbiting scroll member which must overcome the elastic force of the biasing piece by retreating to the planar surface of the biasing piece, which is pressed by the locating piece and is locked with the frame. The prior art improvements described above are defective in design in that the improvements are attained by means of a number of elements at the expense of manufacturing efficiency and assembly precision.

Another prior art improvement is disclosed in the U.S. Pat. No. 5,102,316. This disclosure deals with the non-orbiting scroll member which is provided in the back thereof with a bushing device which is secured to a frame by means of bolts. The non-orbiting scroll member is capalbe of moving axially in conjunction with the bushing device. The axial displacement amount of the non-orbiting scroll member is determined by the difference between the rim thickness of the non-orbiting scroll member and the height of the bushing device. In the meantime, the bottom of the nut serves as a locating surface. When the work fluid in the compression chamber has an abnormal pressure, the non-orbiting scroll member retreats to the locating surface so as to cause the formation of a gap between the orbiting and the non-orbiting scroll members for discharging the work fluid. This prior art improvement is involved with fewer working elements. However, the non-orbiting scroll member is susceptible to being poorly located or being loosened unless the bushing device, the non-orbiting scroll member and the frame are fastened together with precision. Moreover, an additional work must be done with the bottom of the nut, which serves as the locating surface. As a result, this prior art improvement is relatively expensive.

SUMMARY OF THE INVENTION

It is therefore the primary objective of the present invention to provide an improved mechanism for locating the fixed volute of a scroll compressor. The mechanism enables the fixed volute and the orbiting volute of the scroll compressor to form therebetween automatically a gap for discharging the work fluid having an abnormal pressure. The mechanism is simple in construction such that the fixed volute can be easily assembled with precision, and that the fixed volute can be made and assembled economically.

The foregoing objective of the present invention is attained by a locating mechanism of the fixed volute of the scroll compressor, which comprises a housing, a frame, a separating member, a fixed volute, an orbiting volute, a rotary shaft, an eccentric pin, an Oldham ring, and a back pressure mechanism. The frame is mounted in the housing such that the frame and the housing form therebetween a receiving compartment. The separating member is fastened securely in the housing such that the separating member is located over the frame so as to separate the receiving compartment into a high pressure receiving cell and a low pressure receiving cell located between the frame and the separating member. The separating member is provided with an axial hole in communication with the high pressure receiving cell and the low pressure receiving cell. The fixed volute is slightly disklike in shape and is provided with a neck extending out through the center of the top thereof so as to be fastened pivotally in the axial hole. The fixed volute is provided at the bottom thereof with a predetermined number of volute blades located in the low pressure receiving cell. The orbiting volute is slightly disklike in shape and is located under the fixed volute and over the frame. The orbiting volute is provided on the top thereof with a predetermined number of volute blades capable of forming a compression chamber with the blades of the fixed volute. The rotary shaft is mounted in the center of the frame. The eccentric pin is mounted eccentrically at the top of the rotary shaft such that the eccentric pin is fastened pivotally with the bottom of the orbiting volute. The Oldham ring is disposed between the top of the frame and the bottom of the orbiting volute for preventing the orbiting volute from turning. The back pressure mechanism is provided with a predetermined pressure which is intended to force the fixed volute to become attached to the orbiting volute. The present invention is characterized in that the frame is provided on the peripheral wall thereof with a predetermined number of locating faces having respectively a locating threaded hole. The present invention is further characterized in that it is provided with a predetermined number of locating members, each of which has a columnar body, a through hole extending along the longitudinal axis thereof from the top of the columnar body to the bottom of the columnar body, and a sliding connection face of an arcuate construction and located on one side of the columnar body. The sliding connection face is provided on the top thereof with a retaining portion extending outwards. The columnar body of each of the locating members is mounted on the locating face of the frame such that the through hole is opposite in location to the locating threaded hole. The present invention is still further characterized in that it is provded with a plurality of bolts equal in number to the locating members. The bolts have an outer diameter smaller than the inner diameter of the through hole. The bolts are engaged securely with the locating threaded holes of the frame via the through holes of the locating members. The fixed voulte is provided on the disk edge thereof with a plurality of shoulders corresponding in location to the locating members. The shoulders are provided respectively with a sliding connection face of an arcuate construction for engaging the locating member. When the fixed volute is located at the lowest position at which the fixed volute is attached intimately with the orbiting volute, the top of the shoulder is separated from the bottom of the retaining portion of the locating member by a predetermined interval for causing the fixed volute to slide up and down along the sliding connection face of the locating member.

The foregoing objective, features and advantages of the present invention will be more readily understood upon a thoughtful deliberation of the following detailed description of two embodiments of the present invention in conjunction with the accompanying drawings.

DETAILED DESCRIPTION OF THE INVENTION

Figure 1:
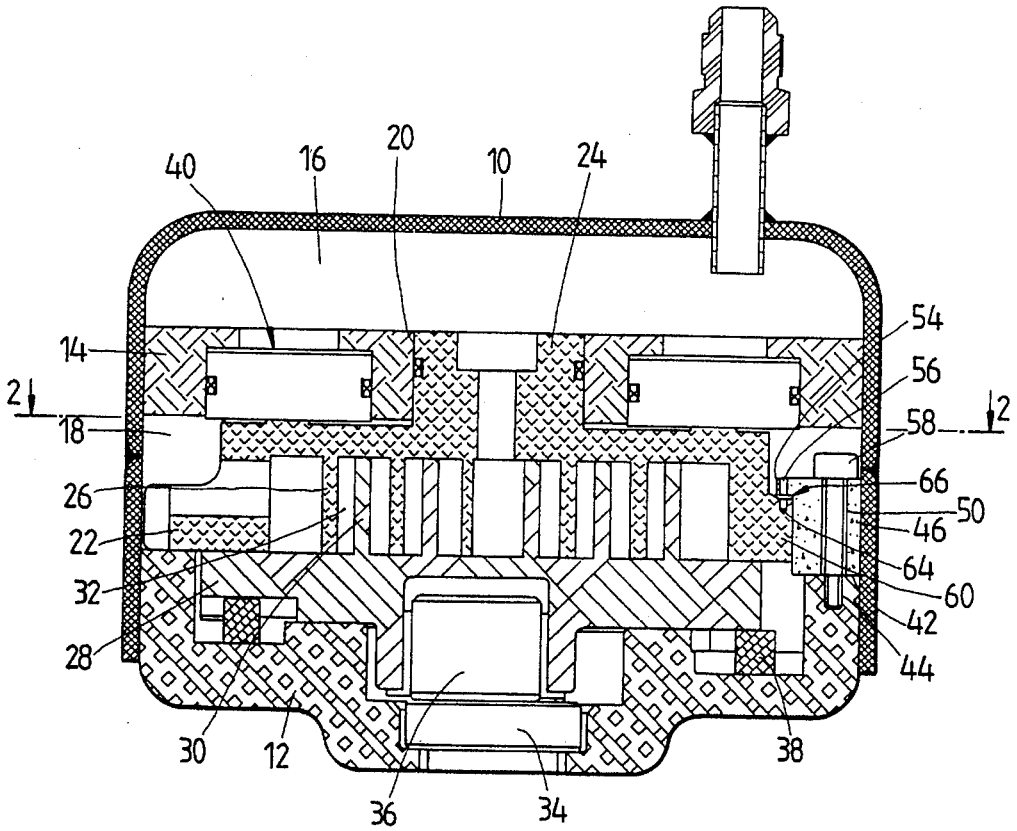
FIG. 1 shows a schematic view of the construction of a first embodiment of the present invention.
Figure 2:
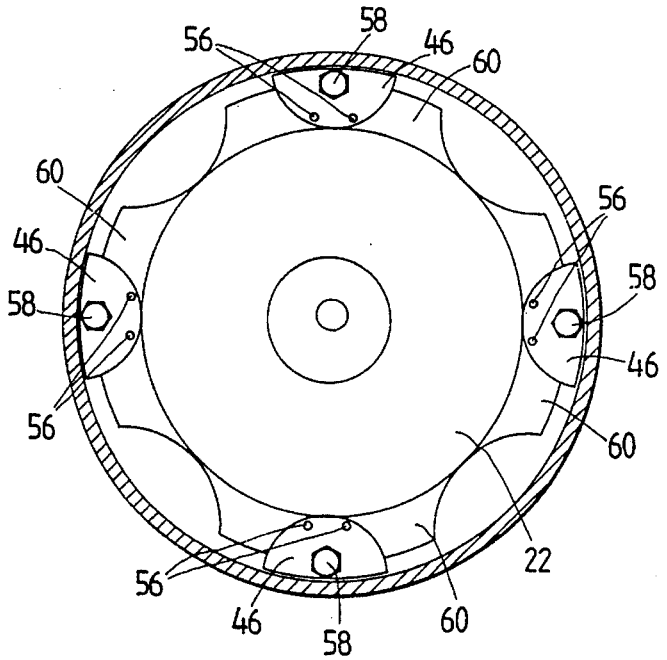
FIG. 2 shows a sectional view of a portion taken along the line 2—2 as shown in FIG. 1.

As shown in FIG. 1, the mechanism embodied in the present invention for locating the fixed volute of a scroll compressor comprises the component parts which are described explicitly hereinafter.

A housing 10 is slightly cylindrical in shape. It must be noted here that the housing 10, as shown in FIG. 1, is only a portion of the housing of the compressor.

A frame 12 is fastened to an open end of the bottom of the housing 10 such that the frame 12 and the housing 10 form therebetween a receiving compartment.

A separating member 14 is fastened securely in the housing 10 such that the separating member 14 is located over the frame 12 and that the separating member 14 divides the receiving compartment into a high pressure receiving cell 16 and a low pressure receiving cell 18 located between the frame 12 and the separating member 14. The separating member 14 is provided centrally with an axial hole 20 in communication with the high pressure receiving cell 16 and the low pressure receiving cell 18.

A fixed volute 22 is slightly disklike in shape and is provided at the center of the top thereof with a neck 24 for fastening pivotally with the axial hole 20. The fixed volute 22 is located in the low pressure receiving cell 18 and is provided at the bottom thereof with a predetermined number of volute blades 26.

An orbiting volute 28 is slightly disklike in shape and is located under the fixed volute 22 and over the frame 12. The orbiting volute 28 is provided on the top thereof with a predetermined number of volute blades 30 capable of cooperating with the blades 26 of the fixed volute 22 to form a compression chamber 32.

A rotary shaft 34 is mounted at the center of the frame 12 and is driven by a motor, which is not shown in the drawing.

An eccentric pin 36 is mounted eccentrically on the rotary shaft 34 and is fastened pivotally with the center of the bottom of the orbiting volute 28.

An Oldham ring 38 is disposed between the top of the frame 12 and the bottom of the orbiting volute 28 for preventing the orbiting volute 28 from rotating.

A back pressure mechanism 40 is provided with a predetermined pressure by which the fixed voulte 22 is forced to become attached to the orbiting volute 28. For more details of the structure and the function of the back pressure mechanism, please refer to the Taiwanese Patent Serial No. 83206713.

With the exception of the back pressure mechanism 40, all component parts described above are similar to those of the prior art and will not be therefore further expounded.

The features of the present invention are further expounded explicitly hereinafter.

The frame 12 is provided on the top of peripheral wall thereof with four locating faces 42, which are spaced equidistantly and are provided thereon respectively with a locating threaded hole 44.

Figure 6:
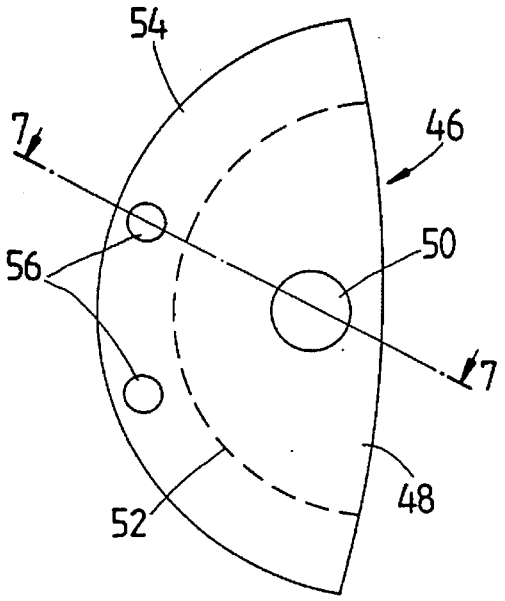
FIG. 6 shows a top view of the locating members embodied in the present invention.
Figure 7:
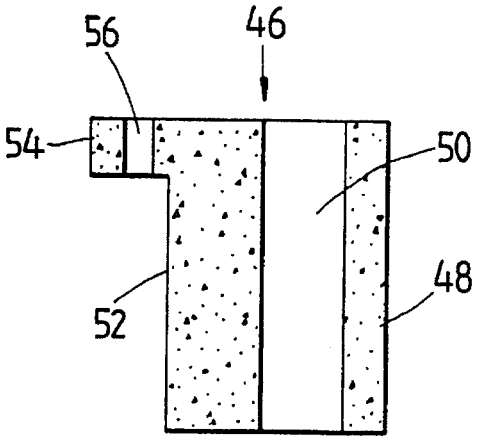
FIG. 7 shows a sectional view of a portion taken along the line 7—7 as shown in FIG. 6.
Figure 9:
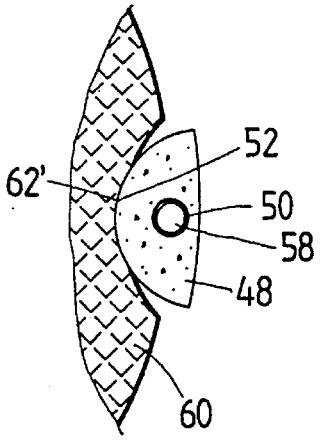
FIG. 9 is similar to FIG. 8, except that the fixed volute of the present invention is shown to have a plurality of sliding connection faces which are of a multi-stepped arcuate construction.
Figure 8:
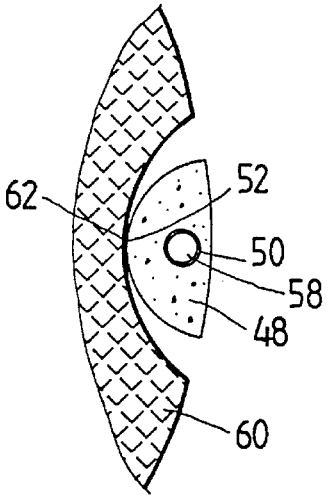
FIG. 8 is a sectional view of a portion taken along the line 8—8 as shown in FIG. 12, showing that the locating members are attached to the sliding connection faces of the fixed volute of the present invention.

As shown in FIGS. 6 and 7, each of four locating members 46 has a columnar body 48, a through hole 50 extending through the top end and the bottom end of the columnar body 48 along the longitudinal axis of the locating member 46, a sliding connection face 52 of an arcuate shape and located on one side of the columnar body 48, a retaining portion 54 extending outwards from the top of the sliding connection face 52, and two through holes 56 located on the retaining portion 54. The four locating members 46 are disposed respectively on the four locating faces 42 of the frame 12 by means of the columnar body 48 thereof such that the through holes 50 are opposite in location to the locating threaded holes 44.

Figure 11:
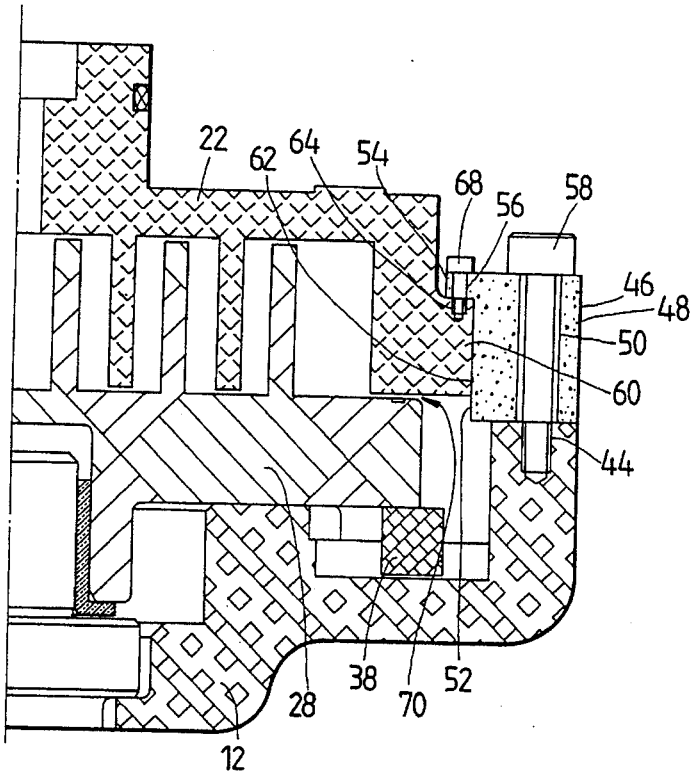
FIG. 11 is similar to FIG. 10, except that the locating members are fastened securely by means of bolts when the locating members are located at the optimum location.
Figure 12:
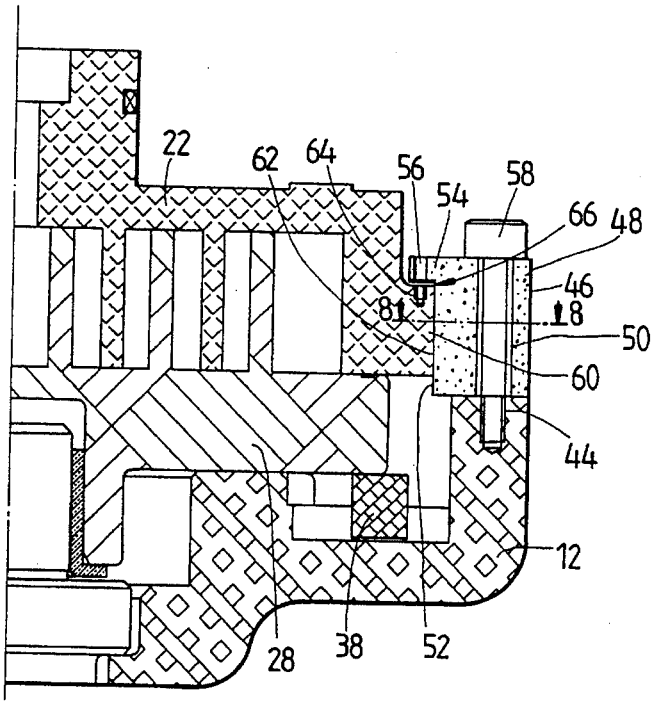
FIG. 12 shows a schematic view of the embodiment in combination according to the present invention.

As shown in FIGS. 11 and 12, four bolts 58 have an outer diameter smaller than the inner diameter of the through holes 50. Four bolts 58 are engaged respectively with the locating threaded holes 44 via the through holes 50.

Figure 3:
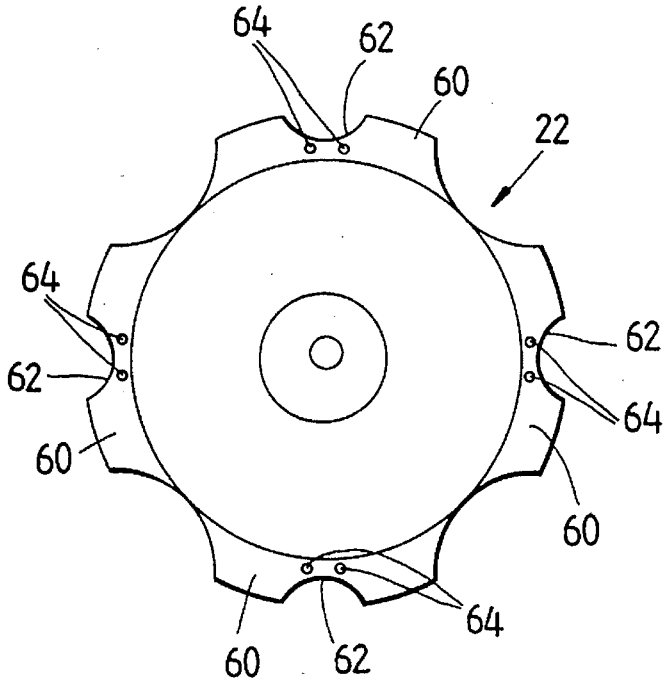
FIG. 3 shows a top view of the fixed volute embodied in the present invention.

The fixed volute 22 is provided on the bottom side of the disk edge thereof with four shoulders 60 corresponding in location to four locating members 46, as shown in FIG. 3. Each shoulder 60 has a sliding connection face 62 of a concave construction and with a curvature radius R greater than or equal to the curvature radius of the sliding connection face 52 of the locating member 46. The sliding connection face 62 is engageable with the sliding connection face 52. Each shoulder 60 further has threaded holes 64 corresponding in location to the through holes 56 of the locating members 46.

Figure 4:
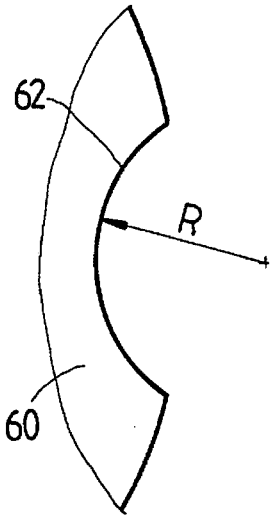
FIG. 4 is an enlarged schematic view of the sliding connection face of the fixed volute of FIG. 3, showing that there is only one arcuate surface.

As shown in FIG. 4, the sliding connection face 62 is of a single-stepped arcuate construction and has a curvature radius designated as R.

Figure 5:
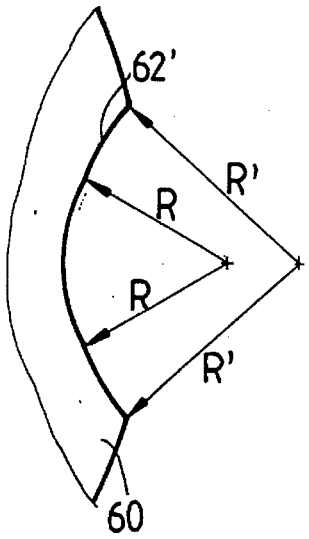
FIG. 5 is similar to FIG. 4, except that FIG. 5 shows a multi-stepped arcuate surface.

As shown in FIG. 5, the sliding connection face 62' is of a multi-stepped arcuate construction. The curvature radius of the middle of the sliding connection face 62' is designated as R, with the curvature radius of both sides thereof being designated as R' which must be greater than R.

As shown in FIG. 12, when the fixed volute 22 is located at the lowest position at which the fixed volute 22 is intimately attached to the orbiting volute 28, the top of the shoulder 60 is separated from the bottom of the retaining portion 54 of the locating member 46 by a predetermined interval 66 for causing the fixed volute 22 to slide up and down along the sliding connection face 52 of the locating member 46.

Figure 10:
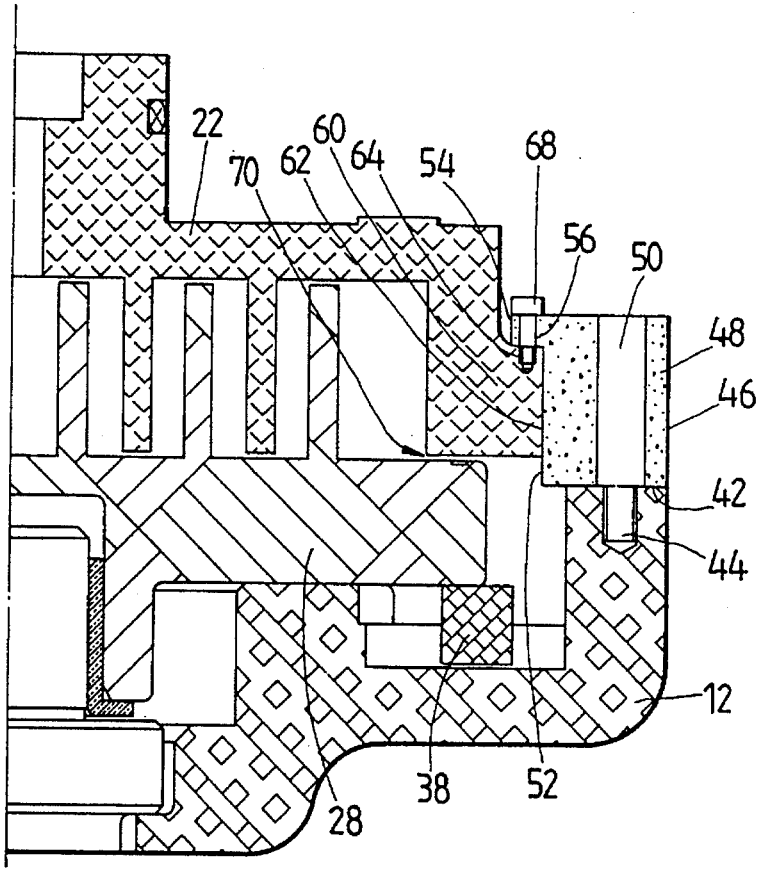
FIG. 10 is a schematic view of the assembly of the embodiment of the present invention, showing that the fixed volute is suspended temporarily by the locating members.

As shown in FIG. 10, before the fixed volute 22 is located, a small bolt 68 is engaged with the threaded hole 64 of the shoulder 60 of the fixed volute 22 via the through hole 56 of the locating member 46. As a result, the fixed volute 22 is fastened temporarily with the locating member 46 such that a gap 70 is formed temporarily between the fixed volute 22 and the orbiting volute 28. In the meantime, the locating member 46 is not yet fastened securely with the frame 12 and is just placed on the locating face 42. As a result, the rotary shaft 34 can be driven slowly by means of another power mechanism so as to actuate the eccentric pin 36 which in turn actuates the orbiting volute 28 to orbit, thereby pushing the fixed volute 22 to be located at the optimum position. The fixed volute 22 can no longer be moved at this time. The locating member 46 can be now fastened securely with the frame 12 by means of a bolt 58 which is received in the through hole 50, as shown in FIG. 11. As the fixed volute 22 is located at the optimum position at which the fixed volute 22 cooperates with the orbiting volute 28, the small bolt 68 can be now disengaged with the threaded hole 64 so as to unfasten the fixed volute 22 with the locating member 46 to allow the fixed volute 22 to descend to the lowest position at which the fixed volute 22 is intimately attached to the orbiting volute 28, as shown in FIG. 12. The interval 66 is therefore formed between the top of the shoulder 60 of the fixed volute 22 and the bottom of the retaining portion 54 of the locating member 46.

Whenever an abnormally high pressure is present in the compression chamber 32 formed by the fixed volute 22 and the orbiting volute 28, the fixed volute 22 is caused to move up along the sliding connection face 52 for a distance which is equal to the interval 66, thereby resulting in the formation of a gap between the fixed volute 22 and the orbiting volute 28. The high pressure of the foreign object contained in the work fluid can be therefore discharged via the gap. After the compression chamber 32 is relieved of the high pressure or the foreign object, the fixed volute 22 is exerted on by the pressure of the back pressure mechanism 40. As a result, the fixed volute 22 is forced to descend automatically to be located at the optimum position at which the fixed volute 22 is expected to become attached intimately with the orbiting volute 28.

The locating mechanism of the present invention prevents the manufacturing errors of the fixed and the orbiting volutes from interfering adversely the assembly of the two volute members. Furthermore, the locating mechanism of the present invention enables the fixed volute and the orbiting volute to be checked and corrected automatically so that they are located at the optimum position.

Figure 13:
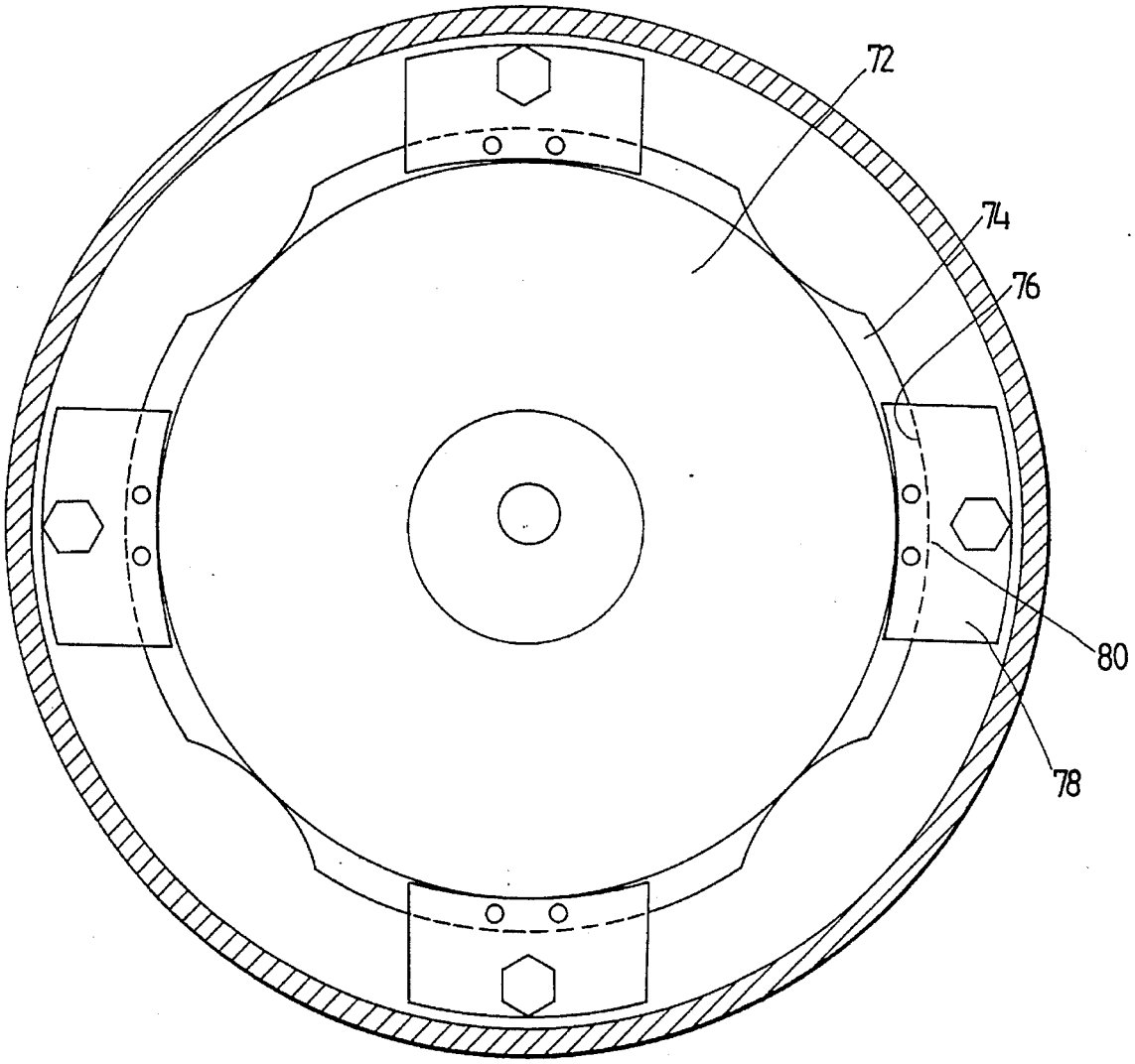
FIG. 13 shows a schematic view of a second preferred embodiment of the present invention.

The working principles of the second preferred embodiment of the present invention are similar to those of the first preferred embodiment of the present invention. As shown in FIG. 13, the second preferred embodiment of the present invention comprises a fixed volute 72 which has a shoulder 74 provided with a sliding connection face 76 of a convex arcuate construction. Attached to the sliding connection face 76 is a locating member 78 which has a sliding connection face 80 of a concave arcuate construction. The sliding connection face 80 has a curvature radius greater than or equal to the curvature radius of the sliding connection face 76 of the fixed volute 72.

What is claimed is:

1. A locating mechanism of the fixed volute of a scroll compressor comprising:

a housing;

a frame fastened with said housing such that said frame and said housing form therebetween a receiving compartment;

a separating member fastened with said housing such that said separating member is located over said frame so as to divide said receiving compartment into a high pressure receiving cell and a low pressure receiving cell located between said frame and said separating member, said separating member provided with an axial hole in communication with said high pressure receiving cell and said low pressure receiving cell;

a fixed volute of a disklike construction and provided centrally on a top thereof with a neck for pivoting in said axial hole and in said low pressure receiving cell, said fixed volute further provided at a bottom thereof with a predetermined number of blades;

an orbiting volute of a disklike construction and located under said fixed volute and over said frame, said orbiting volute provided on a top thereof with a predetermined number of blades capable of cooperating with said blades of said fixed volute to form a compression chamber;

a rotary shaft mounted centrally on said frame;

an eccentric pin mounted eccentrically on a top end of said rotary shaft and fastened pivotally with a bottom of said orbiting volute;

an Oldham ring disposed between a top of said frame and said bottom of said orbiting volute for preventing said orbiting volute from turning; and a back pressure mechanism for providing a predetermined pressure intended to force said fixed volute to become attached to said orbiting volute;

wherein said locating mechanism comprises:

said frame which is provided on a top of a peripheral wall thereof with a predetermined number of locating faces having respectively thereon a locating threaded hole;

a predetermined number of locating members, with each said locating members having a columnar body, a through hole extending along a longitudinal axis thereof from a top end of said columnar body through a bottom end of said columnar body, a sliding connection face of an arcuate construction and located on one side of said columnar body, and a retaining portion extending outwards from a top of said sliding connection face, said locating members being disposed respectively such that said columnar body thereof is located on said locating face of said frame, and that said through hole is opposite in location to said locating threaded hole;

a predetermined number of bolts which are equal in number to said locating members and have an outer diameter smaller than an inner diameter of said through hole, said bolts being engageable with said locating threaded holes of said frame via said through holes of said locating members; and said fixed volute which is provided on a disk edge thereof with a predetermined number of shoulders corresponding in location to said locating members, said shoulders provided respectively with a sliding connection face of an arcuate construction and engageable with said locating member, said shoulders having respectively a top capable of forming a predetermined interval with a bottom of said retaining portion of said locating member at such time when said fixed volute is located at a lowest position at which said fixed volute is intimately attached to said orbiting volute, so as to cause said fixed volute to slide up and down along said sliding connection face of said locating members.

2. The locating mechanism as defined in claim 1, wherein said shoulders of said fixed volute are provided respectively with a temporary member enabling each of said shoulders to be fastened securely with said retaining portion of each of said locating members, so as to enable said fixed volute and said orbiting volute to form therebetween a gap.

3. The locating mechanism as defined in claim 2, wherein said shoulders of said fixed volute are provided with a predetermined number of threaded holes; and wherein said retaining portions of said locating members are provided with a predetermined number of through holes corresponding in location to said threaded holes which are engageable with a predetermined number of fastening means which are received in said through holes for fastening temporarily said fixed volute with said locating members.

4. The locating mechanism as defined in claim 3, wherein said shoulders are provided respectively with two or more said threaded holes; and wherein said locating members are provided with through holes corresponding in number to said threaded holes.

5. The locating mechanism as defined in claim 1, wherein said sliding connection face of said fixed volute is of a concave construction; and wherein said sliding connection face of said locating member is of a convex construction.

6. The locating mechanism as defined in claim 5, wherein said sliding connection face of said fixed volute is of a single-stepped arcuate construction.

7. The locating mechanism as defined in claim 5, wherein said sliding connection face is of a multi-stepped arcuate construction having curvature radii which become greater progressively toward an outer side thereof from a center thereof.

8. The locating mechanism as defined in claim 5, wherein said sliding connection face of said locating member is of a single-stepped arcuate construction.

9. The locating mechanism as defined in claim 1, wherein said sliding connection face of said fixed volute is of a convex arcuate construction; and wherein said sliding connection face of said locating member is of a concave arcuate construction.

* * * * *